US011384620B2

(12) United States Patent
Holly et al.

(10) Patent No.: US 11,384,620 B2
(45) Date of Patent: Jul. 12, 2022

(54) BRIDGE PLUG WITH MULTIPLE SEALING ELEMENTS

(71) Applicant: Halliburton Energy Services, Inc., Houston, TX (US)

(72) Inventors: Mark Holly, The Colony, TX (US); Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 670 days.

(21) Appl. No.: 16/336,819

(22) PCT Filed: Apr. 27, 2018

(86) PCT No.: PCT/US2018/029931
§ 371 (c)(1),
(2) Date: Mar. 26, 2019

(87) PCT Pub. No.: WO2019/209336
PCT Pub. Date: Oct. 31, 2019

(65) Prior Publication Data

US 2021/0355781 A1 Nov. 18, 2021

(51) Int. Cl.
*E21B 33/129* (2006.01)
*E21B 33/134* (2006.01)

(52) U.S. Cl.
CPC ..... *E21B 33/134* (2013.01); *E21B 33/129* (2013.01)

(58) Field of Classification Search
CPC ..... E21B 33/1277; E21B 33/1292; E21B 33/129; E21B 33/134; E21B 33/128
See application file for complete search history.

(56) References Cited

U.S. PATENT DOCUMENTS

| | | | | |
|---|---|---|---|---|
| 6,167,963 | B1 | 1/2001 | McMahan et al. | |
| 6,796,376 | B2 * | 9/2004 | Frazier | E21B 33/129 |
| 7,735,549 | B1 * | 6/2010 | Nish | E21B 33/134 166/134 |
| 8,205,671 | B1 | 6/2012 | Branton | |
| 8,490,689 | B1 * | 7/2013 | McClinton | E21B 33/134 166/135 |
| 8,887,818 | B1 * | 11/2014 | Carr | E21B 33/128 166/387 |
| 9,353,596 | B2 * | 5/2016 | Raggio | E21B 33/134 |
| 11,078,739 | B2 * | 8/2021 | Davies | E21B 33/1293 |
| 2004/0069502 | A1 | 4/2004 | Luke | |
| 2004/0149429 | A1 | 8/2004 | Dilber et al. | |

(Continued)

FOREIGN PATENT DOCUMENTS

WO 2015-077722 A1 5/2015

OTHER PUBLICATIONS

International Search Report & Written Opinion issued for Corresponding International Application No. PCT/US2018/029931 dated Feb. 1, 2019. (15 pages).

*Primary Examiner* — Daniel P Stephenson
(74) *Attorney, Agent, or Firm* — McGuireWoods LLP

(57) ABSTRACT

Included are bridge plugs and methods and systems for the use and deployment of the bridge plugs. An example bridge plug comprises a first sealing element, a second sealing element, and a spacer; wherein the spacer is disposed between the first sealing element and the second sealing element; wherein the first sealing element and the second sealing element are not adjacent to one another.

20 Claims, 8 Drawing Sheets

(56) References Cited

U.S. PATENT DOCUMENTS

| | | | | |
|---|---|---|---|---|
| 2010/0155077 | A1 | 6/2010 | Jardim De Azevedo et al. | |
| 2014/0311752 | A1* | 10/2014 | Streich | E21B 33/1204 166/376 |
| 2016/0265303 | A1 | 9/2016 | Dockweiler | |
| 2021/0355781 | A1* | 11/2021 | Holly | E21B 33/1292 |

* cited by examiner

BRIDGE PLUG WITH MULTIPLE SEALING ELEMENTS

TECHNICAL FIELD

The present disclosure relates to bridge plugs, and more particularly, to bridge plugs with multiple sealing elements used to form seals in open-hole environments.

BACKGROUND

Bridge plugs are downhole tools used to seal and isolate the zones downhole of the bridge plug from the zones uphole of the bridge plug. A bridge plug may be permanent or retrievable. Bridge plugs may be used during production or plug and abandon operations. During or prior to production, the bridge plug may be used to seal a downhole zone to prevent water flowing from a water producing formation to the producing zones uphole of the bridge plug. In a plug and abandon operation, the bridge plug is used as plug fundament by forming a seal sufficient to hold a cement such that the cement may set and harden into a permanent cement plug.

Bridge plugs use sealing elements to form a seal in the wellbore. These sealing elements expand to contact an adjacent surface, resulting in a seal at the interface of the adjacent sealing surface. In some operations, the sealing element may not form a sufficient seal at the sealing surface interface. For example, in some wellbores a piece of debris may be present on or near the sealing surface, creating an irregular sealing surface shape that cannot be sealed by the bridge plug. As another example, if sealing is desired between coupled conduits, a gap may be present that creates an irregular sealing surface. The sealing element of the bridge plug may be unable to sufficiently seal this gapped area. In addition to irregular sealing surfaces, rough surfaces may also present problems for the sealing elements. For example, the rough surface of an open hole (e.g., an uncased) portion of a wellbore may be too rough to form a seal capable of withstanding the a differential in either direction. As such, the seal may leak which may result in the failure of the zonal isolation or plugging operation.

Should the bridge plug leak, and therefore allow flow or pressure to traverse the sealing element, remediation operations may be needed to reseal the wellbore. For example, if a bridge plug is not sufficiently sealed such that a cement plug could be formed thereon. A new bridge plug may have to be set, and another cement plugging operation may need to be conducted to form the desired cement plug. Moreover, multiple bridge plugs may be required for operations in which rough or irregular surfaces may be present, resulting in added time and expense. Lastly, if gaps or other known irregular surfaces or present, an operator may have to place a bridge plug in a less desirable location to reduce the risk of contacting the irregular surface area. Seal leaks and remediation operations can result in a loss of productive time and increased operational expenditures.

BRIEF DESCRIPTION OF THE DRAWINGS

Illustrative examples of the present disclosure are described in detail below with reference to the attached drawing figures, which are incorporated by reference herein, and wherein.

Figure 1:
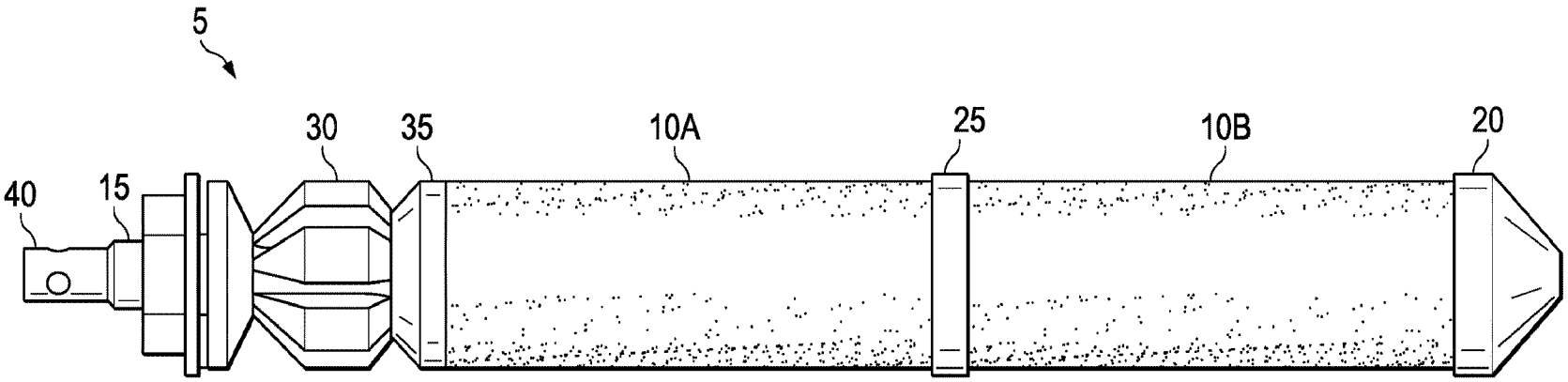
FIG. 1 is an orthogonal view of an example bridge plug illustrated in its run-in-hole configuration in accordance with one or more examples described herein.

The illustrated figures are only exemplary and are not intended to assert or imply any limitation with regard to the environment, architecture, design, or process in which different examples may be implemented.

DETAILED DESCRIPTION

The present disclosure relates to bridge plugs, and more particularly, to bridge plugs with multiple sealing elements used to form seals in open-hole environments.

In the following detailed description of several illustrative examples, reference is made to the accompanying drawings that form a part hereof, and in which is shown by way of illustration specific examples that may be practiced. These examples are described in sufficient detail to enable those skilled in the art to practice them, and it is to be understood that other examples may be utilized and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples are defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present invention. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

The examples described herein comprise a bridge plug having multiple sealing elements that are not immediately adjacent to one another. One of the many potential advantages of the disclosed bridge plug is that the multiple sealing elements may create multiple seals, thereby reducing the risk of leakage across all sealing elements and strengthening the overall sealing of the bridge plug. Another potential advantage of the disclosed bridge plug is that the multiple sealing elements are not located immediately adjacent to each other, as such there is a gap of a defined space between the formed seals. Spacing the sealing elements reduces the risk that the seals may encounter the same irregular surface or obstruction at the sealing surface. This may result in an increased probability of forming a sufficient seal on surfaces that may be difficult to seal. Yet an additional advantage of the disclosed bridge plug is that the multiple sealing elements may be set in the same run. As such, the bridge plug may be used to create multiple seals in one downhole run. One more additional advantage of the disclosed bridge plug is that multiple sealing elements provide an overall larger sealing surface, which may be beneficial for forming seals at rough sealing surfaces, such as those of an open hole environment. Increasing the sealed area increases the seal's ability to withstand a target differential range in either direction of the seal.

FIG. 1 is an orthogonal view of an example bridge plug, generally 5, illustrated in its run-in-hole configuration. Bridge plug 5 comprises at least two sealing elements, 10A and 10B. Sealing elements 10A and 10B may comprise the same or different materials. Although only two sealing elements are illustrated, it is to be understood that the bridge plug 5 may comprise more than two sealing elements in some examples, for example, bridge plug 5 may comprise sealing element 10A, sealing element 10B, sealing element 10C, and so on. Sealing elements 10A and 10B are disposed on mandrel 15. Mandrel 15 is an elongated cylindrical structure comprising a metal or metal alloy of sufficient durability and resilience to withstand the wellbore conditions and to allow for setting of the bridge plug 5. In preferred examples, mandrel 15 is solid and does not possess an inner cavity throughout its length. At the downhole terminal end of bridge plug 5 is disposed bottom cone 20. Bottom cone 20 is a conically shaped structure of sufficient durability and shape to guide the bridge plug 5 through or past any restriction(s) which may occur in the wellbore and/or tubing that the bridge plug 5 may traverse as it is guided to a desired target location. Bottom cone 20 may comprise any suitable metal or metal alloy. Bottom cone 20 is coupled to mandrel 15 and is adjacent to sealing element 10B. As discussed below, a setting tool (not illustrated) may be coupled to mandrel 15 and may be used to generate a sufficient linear force to pull the bottom cone 20 or the portion of mandrel 15 coupled to the bottom cone 20 in an uphole direction (i.e., to the left in the illustration). This movement of bottom cone 20 in an uphole direction results in the compression of the sealing element 10B in its axial direction which induces the expansion of sealing element 10B in its radial direction.

With continued reference to FIG. 1, in-between the sealing elements 10A and 10B is a spacer 25. The spacer 25 is used to produce a gap between the seals formed by sealing elements 10A and 10B. Spacer 25 is not compressible. As such, the length of spacer 25 determines the length of the gap between the seals formed from sealing elements 10A and 10B when they have been set into their sealing configurations. Spacer 25 should be sized sufficiently to reduce the possibility of an obstruction or otherwise irregular surface element from being present at or near the sealing surface of both of the sealing elements 10A and 10B when set. For example, if there is a known gap or debris present at or about the desired sealing area, the spacer 25 should be of sufficient length that the gap or debris could not be present at the interface of both formed seals when set. Spacer 25 is an elongated cylindrical structure comprising a metal or metal alloy of sufficient durability and resilience to withstand the wellbore conditions and to allow for setting of the bridge plug 5. Spacer 25 comprises a void producing an inner diameter sufficient for the mandrel 15 to pass therethrough. As discussed below, a setting tool (not illustrated) may be coupled to mandrel 15 and may be used to generate a sufficient linear force to pull the spacer 25 or the portion of mandrel 15 coupled to the spacer 25 in an uphole direction (i.e., to the left in the illustration). This movement of spacer 25 in an uphole direction results in the compression of the sealing element 10A in its axial direction which induces the expansion of sealing element 10A in its radial direction.

Although not illustrated, some optional examples of bridge plug 5 may further comprise backups immediately adjacent to both terminal ends of each of the sealing elements 10A and 10B. The backups may be angled and/or expandable and may be used to prevent extrusion of sealing elements 10A and 10B. These optional backups would be disposed on both terminal ends of spacer 25. In examples comprising more than two sealing elements, a spacer 25 may be disposed between each pair of sealing elements to provide a gap of sufficient size between each pair of sealing elements (e.g., between sealing elements 10A and 10B, between sealing elements 10B and 10C, and so on).

As illustrated in FIG. 1, bridge plug 5 further comprises a plurality of slips 30, which are disposed towards the uphole terminal end of the bridge plug 5. The slips 30 are adjacent to a slip cone 35 used to expand the slips 30 radially. Each individual slip 30 comprises an arm-like structure having an outer surface having at least one outwardly extending serration, tooth, ridge, slit, or otherwise any abrasive gripping surface that is sufficient to assist the slips 30 in anchoring the bridge plug 5 to an adjacent surface such as a wellbore wall. The slips 30 may be coupled to the slip cone 35 by a shearable structure or other such mechanism for actuating the expansion of the slips 30 when desired. The shearable structure allows for deformation of the slips 20 as desired and also prevents premature actuation of the slips 30. The shear force necessary to actuate the slips 30 with the slip cone 35 may be determined by the shear strength of the material of the shearable structure chosen to couple the slips 30 to the slip cone 35, as would be readily apparent to one of ordinary skill in the art with the benefit of this disclosure. As such, the slip cone 35 may be actuated before any of the sealing elements 10A and 10B, allowing the setting sequence of the bridge plug 5 to be controlled and the bridge plug 5 to be successfully anchored in a desired position before the sealing elements 10A and 10B are actuated to begin the sealing portion of the operation.

In the illustrated example, the slips 30 comprise a deformable metal or metal alloy. After shearing, the slip cone 35 is free to be pressed or pulled against the slips 30 to pressure the slips 30, inducing the outward expansion of their arm-like structure. An inner surface of the slips 30 may be tapered to complement the outer surface of the slip cone 35. The slips 30 may continue to expand radially until they engage an adjacent surface. The slips 30 may engage a wall of a wellbore, for example, in an open-hole portion of a wellbore. Alternatively, the slips 30 may engage the inner diameter of a casing or other tubular. Any number of slips 30 may be used to provide sufficient anchoring of the bridge plug 5. With the benefit of this disclosure, one of ordinary skill in the art would be readily able to determine the amount of slips 30 necessary to sufficiently anchor the bridge plug 5.

As discussed, the slips 30 in the illustrated example comprise a deformable metal or metal alloy to anchor the bridge plug 5. In this specific example, bridge plug 5 would not be retrievable and would be used for operations such as plug-and-abandon. In an alternative example, the slips 30 may not be deformable. In this alternative example, the slips 30 may comprise hinges allowing the slips 30 to return to the run-in-hole position after expansion into the set-position. The bridge plug 5 of this alternative example would be retrievable and may be used for operations in which temporary zonal isolation, for example, to reduce water production, may be desirable. The hinged slips 30 may be biased towards the axial direction or may be configured to expand and retract upon actuation by the setting tool.

Bridge plug 5 further comprises a setting tool coupling 40. The setting tool coupling 40 is disposed on the uphole terminal end of the mandrel 15. The setting tool coupling 40 couples the bridge plug 5 to the setting tool to attach bridge plug 5 to the setting tool so that bridge plug 5 may be deployed in a wellbore. For clarity of illustration, a setting tool is not illustrated, but it is to be understood that any setting tool for setting a bridge plug may be used. One example of a sufficient setting tool comprises an electromechanical assembly that produces a linear force sufficient for setting or pulling the bridge plug 5. The setting tool may be coupled to a wireline and lowered into the wellbore with the bridge plug 5 attached.

Figure 2:
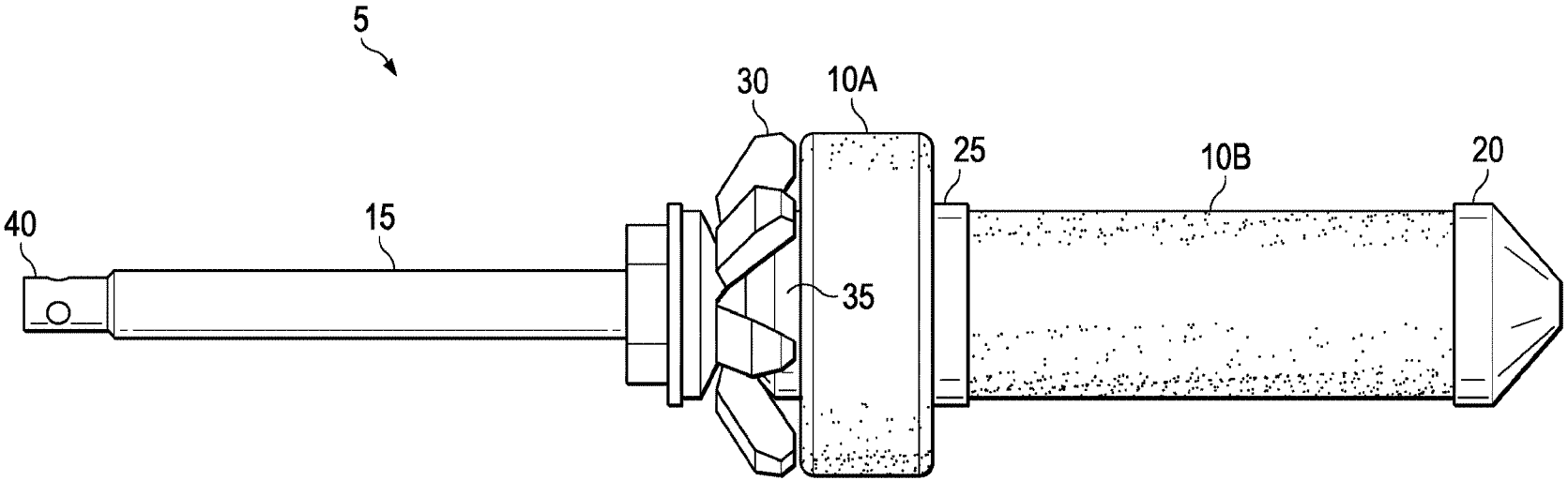
FIG. 2 is an orthogonal view of the example bridge plug of FIG. 1 illustrated in its anchored configuration in accordance with one or more examples described herein.

FIG. 2 is an orthogonal view of the example bridge plug 5 of FIG. 1 illustrated in its anchored configuration. In the illustrated example, a setting tool (not illustrated) may generate a sufficient linear force to shear the shearable structure that had fixed slip cone 35 and slips 30 in the run-in-hole position illustrated in FIG. 1. As the shearable structure has been sheared, the slip cone 35 may be pulled, via the pulling of the connected mandrel 15, in the uphole direction (i.e., to the left-position illustrated in FIG. 2). As the slip cone 35 is pulled to this left-position it presses against the interior surface 30 of the slips 30, which are tapered as discussed above and acts as a cam to push the slips 30 outward, inducing the radial expansion of the slips 30. This radial expansion may continue until contact is made with an adjacent surface such as a wellbore wall or the surface of the inner diameter of a conduit such as a tubing or casing. The expanded slips 30 may then engage said adjacent surface with sufficient force to anchor the bridge plug 5 at that specific location.

After the slips 30 have anchored the bridge plug 5, the setting tool may continue to generate a linear force to pull the mandrel 15 to the left-position. Spacer 25 may be pulled to the left position in sequence after the slips 30 have been deployed as described. As spacer 25 is pulled to the left, the sealing element 10A is compressed in its axial direction, inducing it to expand in its radial direction. This outward expansion away from the center of the bridge plug 5 may continue so long as the seal element 10A is compressed in its axial direction and until contact is made with an adjacent surface. The spacer 25 may be held in position with the mandrel 15 by a shearable structure having a shear strength greater than that of the shearable structure of the slip cone 35. As such, the actuation of sealing element 10A occurs after the bridge plug 5 is anchored by the slips 30. The shearable structure thus prevents premature actuation of sealing element 10A and also allows for sealing element 10A to be set in sequence.

Sealing element 10A expands in its radial direction to make contact with the adjacent surface to be sealed. Upon contact with an adjacent surface, a seal is formed which may be substantially fluid and pressure tight. As such, the bridge plug 5 is now anchored and partially set.

Figure 3:
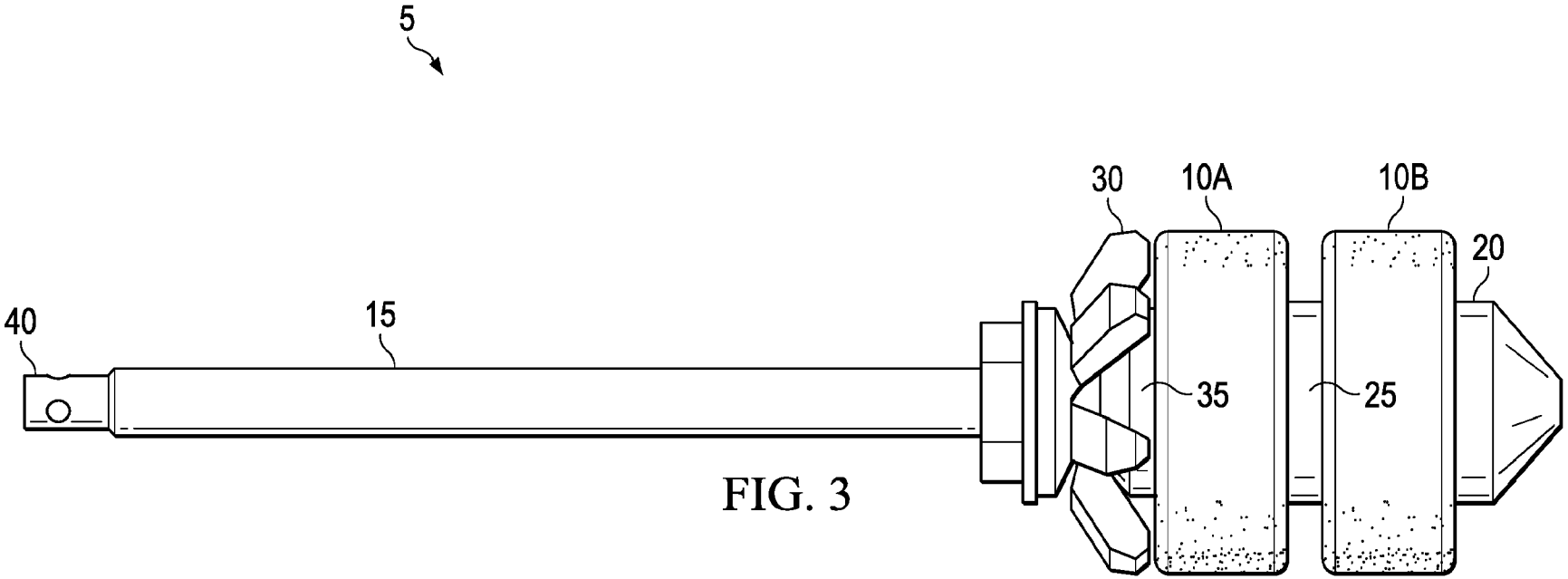
FIG. 3 is an orthogonal view of the example bridge plug of FIGS. 1 and 2 illustrated in its fully-set configuration in accordance with one or more examples described herein.

FIG. 3 is an orthogonal view of the example bridge plug 5 of FIGS. 1 and 2 illustrated in its fully-set configuration. In the illustrated example, the setting tool (not illustrated) continues to generate a sufficient linear force to pull the mandrel 15 to the left-position. Bottom cone 20 may be pulled in the uphole direction in sequence after the spacer 25 has been pulled to the left position and the sealing element 10A has been expanded in the radial direction due to compression in the axial direction. As bottom cone 20 is pulled to the left, the sealing element 10B is compressed in its axial direction, inducing it to expand in its radial direction. This outward expansion away from the center of the bridge plug 5 may continue so long as the seal element 10B is compressed in its axial direction and until contact is made with an adjacent surface. The bottom cone 20 may be held in position with the mandrel 15 by a shearable structure having a shear strength greater than that of the shearable structure of the spacer 25. As such, the actuation of sealing element 10B occurs after the actuation of sealing element 10A. The shearable structure thus prevents premature actuation of sealing element 10B and also allows for sealing element 10B to be set in sequence.

Sealing element 10B expands in its radial direction to make contact with the adjacent surface to be sealed. Upon contact with an adjacent surface, a seal is formed which may be substantially fluid and pressure tight. As such, the bridge plug 5 is now anchored and fully set as both sealing elements 10A and 10B have been actuated and used to form seals in the wellbore. Subsequent operations may now be commenced, for example, a cement may be placed on the set bridge plug 5 to form a cement plug.

Although FIGS. 2 and 3 illustrate actuation of sealing element 10B after that of sealing element 10A, it is to be understood that the sealing elements 10A and 10B may be actuated in the opposite order if desired. This reverse actuation sequence may be performed by adjusting the shear strength of the shearable structure holding the bottom cone 20 in position with the mandrel 15 to be less than the shear strength of the shearable structure holding the spacer 25 in position with the mandrel 15. As such, the shearable structure maintaining the position of the bottom cone 20 will shear first when pressured, resulting in actuation of the sealing element 10B before that of the sealing element 10A.

Moreover, in a further alternative example, the actuation of the sealing elements 10A and 10B may be performed near simultaneously. This simultaneous actuation sequence may be performed by adjusting the shear strength of the shearable structure holding the bottom cone 20 in position with the mandrel 15 to be substantially equal with the shear strength of the shearable structure holding the spacer 25 in position with the mandrel 15. As such, the shearable structure maintaining the position of the bottom cone 20 will shear at roughly the same time as the shearable structure maintaining the position of the spacer 25. This may result in the simultaneous actuation of sealing elements 10A and 10B.

With reference to FIGS. 1-3, as illustrated, the bridge plug 5 was anchored and fully set in one trip downhole. Multiple seals were formed with only one bridge plug. The seals are sufficiently spaced to reduce the likelihood of poor seal formation from the presence of irregular surfaces and/or rough surfaces. Multiple sealing elements are used to provide sealing redundancy and increase the sealed surface area, reducing the risk of seal failure.

It should be clearly understood that the bridge plug 5 of FIGS. 1-3 is merely one example of an application of the principles of this disclosure in practice, and a wide variety of other examples are possible. Therefore, the scope of this disclosure is not limited at all to the details of FIG. 1-3 described herein and/or depicted in any of the other FIGURES.

Figure 4:
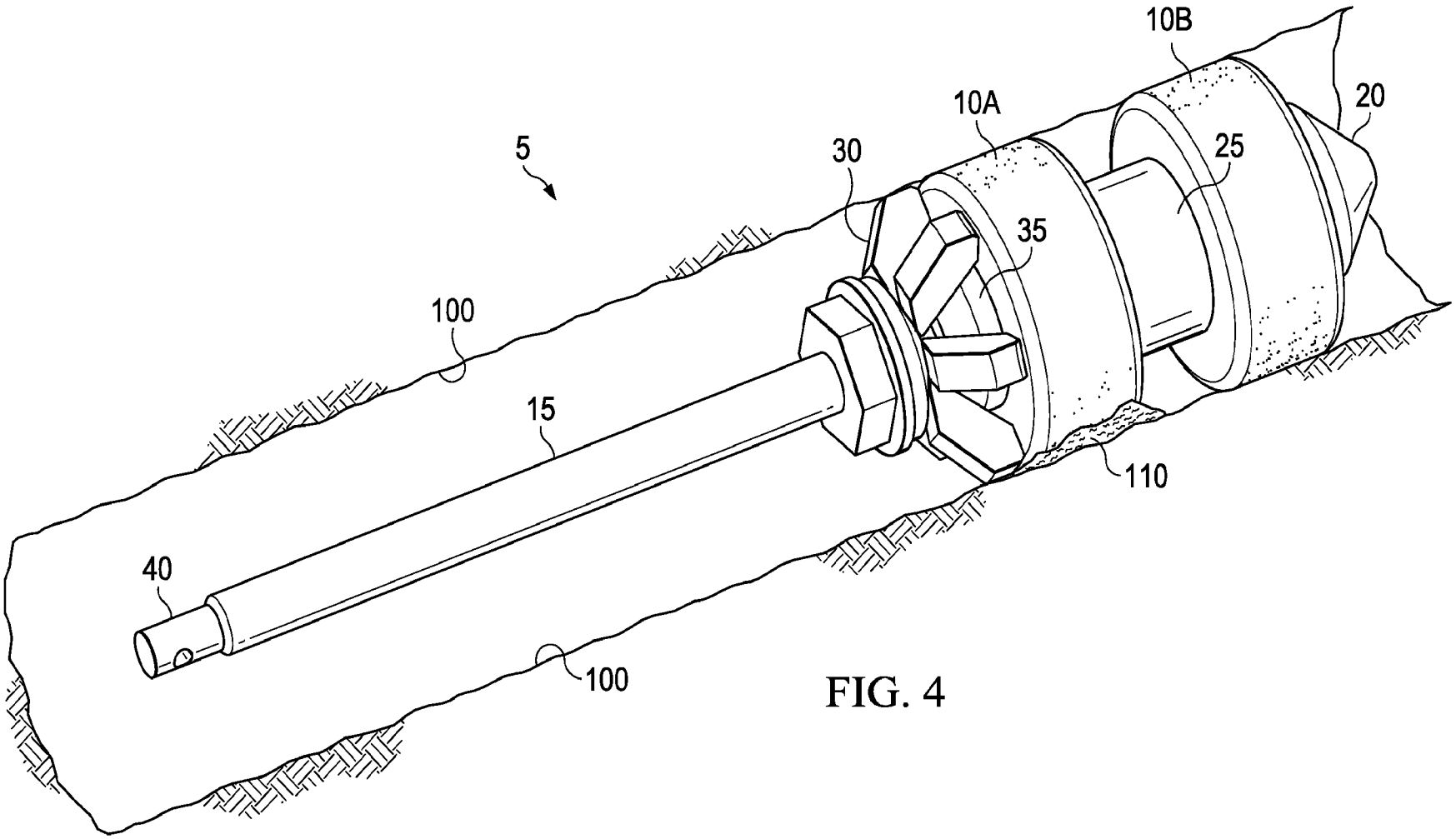
FIG. 4 is an isometric illustration of the bridge plug of FIGS. 1-3 as set in a wellbore having an irregular sealing surface in accordance with one or more examples described herein.

FIG. 4 is an isometric illustration of the bridge plug 5 of FIGS. 1-3 as set in a wellbore 100 having an irregular sealing surface. Wellbore 100 is an uncased portion of a wellbore. It is to be understood that bridge plug 5 may be used in any portion of any wellbore, including a cased or uncased portion. As illustrated, slips 30 have been expanded and engaged wellbore wall 105. Engagement of slips 30 with wellbore wall 105 anchors the bridge plug 5 in the wellbore 100 as illustrated. Sealing elements 10A and 10B were deployed to form a seal in wellbore 100. The setting tool was then removed after the bridge plug 5 was set.

Debris 110 was present in wellbore 100 at the time of setting. Debris 110 creates an irregular sealing surface on wellbore wall 105. Sealing element 10A contacted debris 110 as it was radially expanded. The seal formed by sealing element 10A was thus formed against a sealing surface incorporating at least a portion of debris 110. The irregular sealing surface may create gaps or other voids in the seal formed by sealing element 10A. The presence of these voids may render the seal formed by sealing element 10A to be insufficient, and as such, it may not be substantially fluid and pressure tight. Moreover, even if there are no voids present in the seal, the debris 110 may shift while sealed or otherwise cause a leak in the seal, increasing the risk of seal failure over the length of the operation.

With continued reference to FIG. 4, sealing element 10B has radially expanded to form a seal against the wellbore wall 105. Sealing element 10B is not adjacent to sealing element 10A and is spaced a desired distance apart from sealing element 10A by spacer 25. This spacing has allowed the seal formed by sealing element 10B to not contact debris 110. As such, the seal formed by sealing element 10B is a substantially fluid and pressure tight seal that comprises a reduced risk of failure as compared with the seal formed by sealing element 10A. Despite the presence of debris 110 in the seal formed by sealing element 10A, subsequent wellbore operations may be commenced, as the seal formed by sealing element 10B is sufficient to hold a cement, restrict water, etc. Therefore, bridge plug 5 may be used to form multiple seals in the wellbore 100 in one trip while minimizing the risk of seal failure due to rough or irregular sealing surfaces. As such, bridge plug 5 may be used to seal areas containing rough or irregular sealing surfaces such as uncased wellbores, mines, and the like.

It should be clearly understood that the bridge plug 5 of FIG. 4 is merely one example of an application of the principles of this disclosure in practice, and a wide variety of other examples are possible. Therefore, the scope of this disclosure is not limited at all to the details of FIG. 1-3 described herein and/or depicted in any of the other FIGURES.

Figure 5:
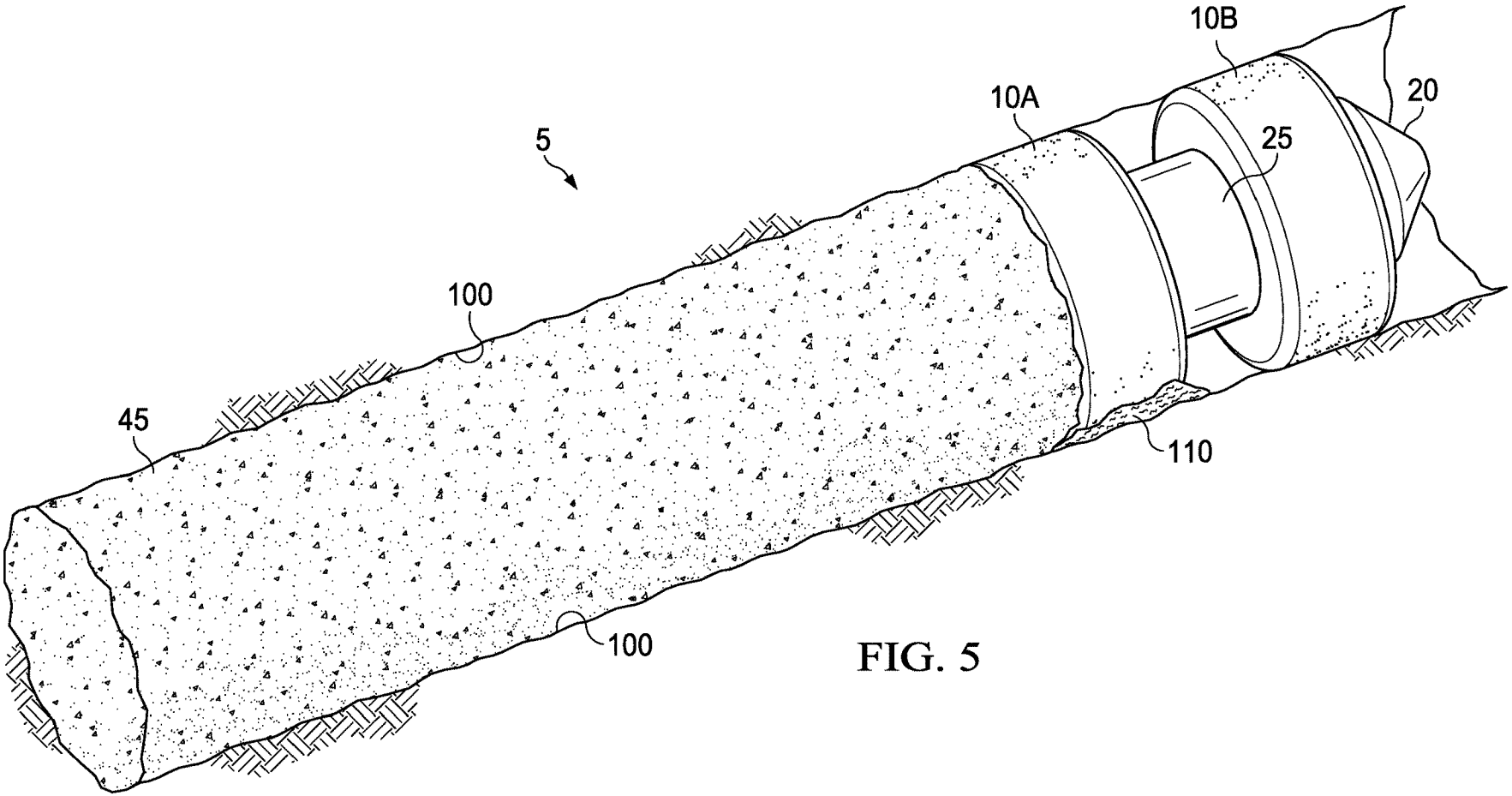
FIG. 5 is an isometric illustration of the bridge plug of FIGS. 1-3 after cement has been pumped into the wellbore in accordance with one or more examples described herein.

FIG. 5 illustrates the bridge plug 5 after cement 45 has been pumped into the wellbore 100. Cement 45 may rest and set uphole of the bridge plug 5 as illustrated.

Figure 6:
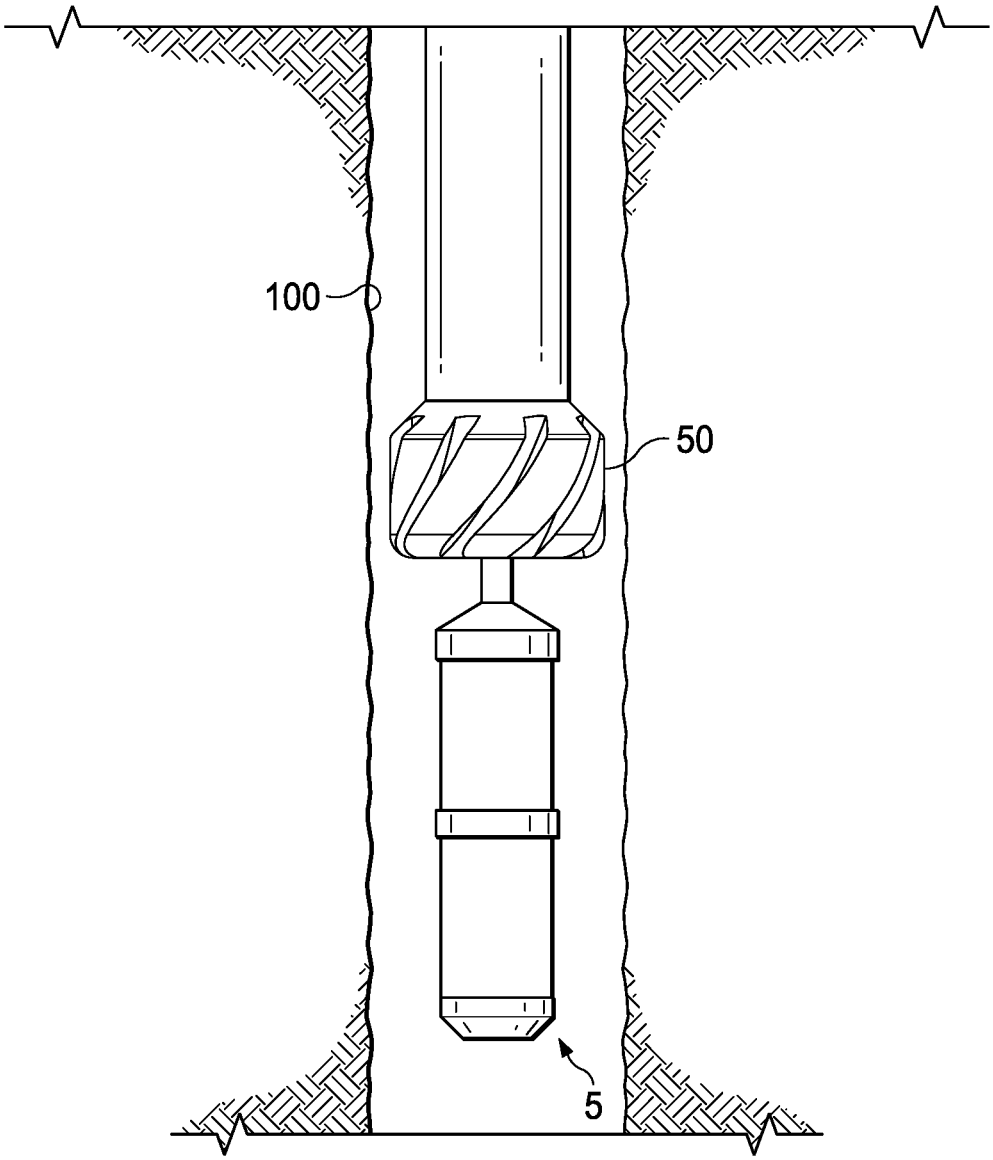
FIG. 6 is a cross-section of the bridge plug of FIGS. 1-3 descending through the bit of a bottom hole assembly in accordance with one or more examples described herein.

FIG. 6 is illustrates bridge plug 5 descending through the bit 50 of a bottom hole assembly. Bridge plug 5 may be introduced into the wellbore 100 through the bit 50 and then lowered to a desired position and actuated as desired.

Figure 7:
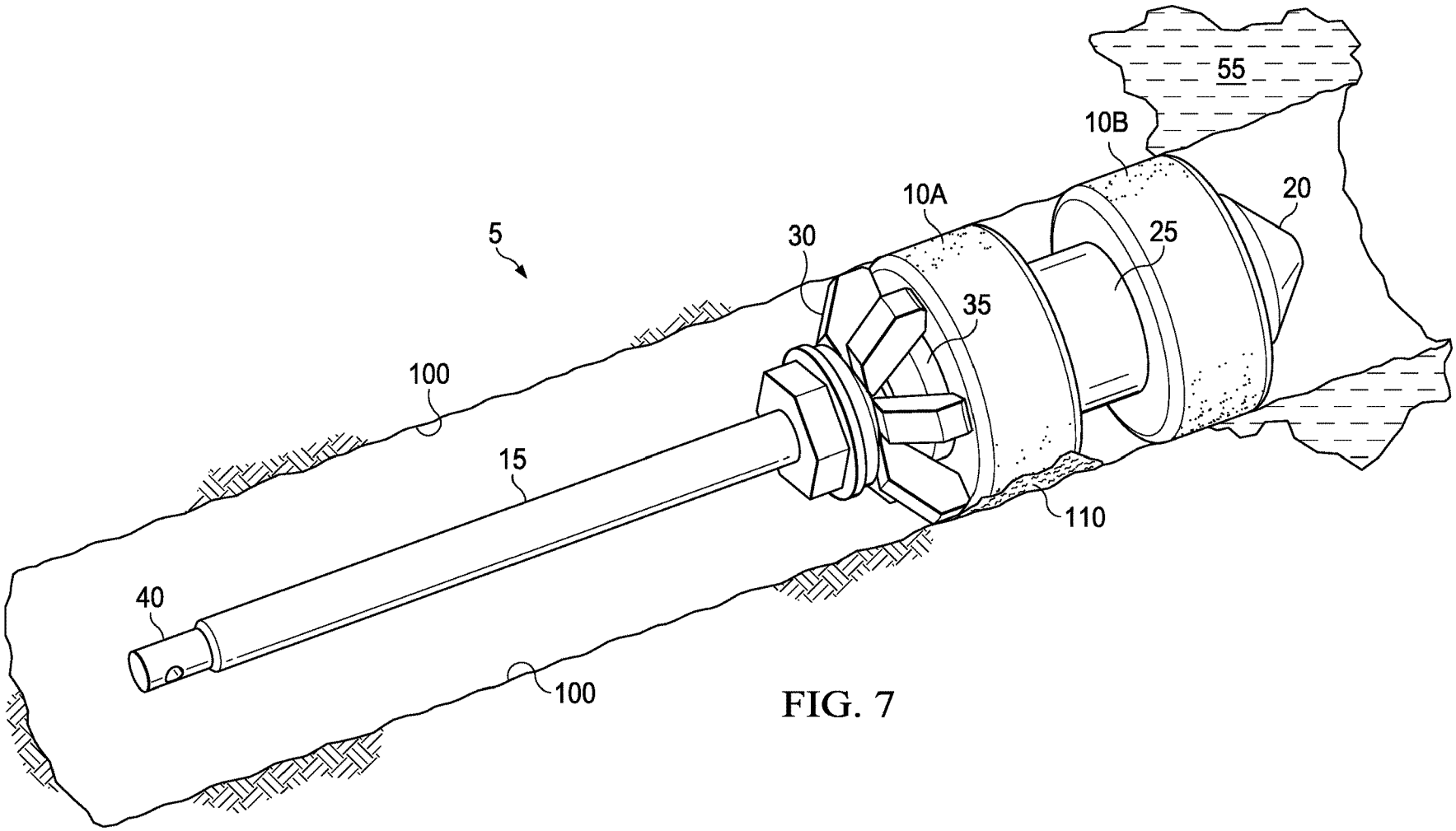
FIG. 7 is an isometric illustration of the bridge plug of FIGS. 1-3 isolating a water producing zone in accordance with one or more examples described herein.

FIG. 7 is illustrates bridge plug 5 isolating a downhole water producing zone 55. After isolation of the downhole water producing zone 55. Upstream wellbore operations may be commenced.

Figure 8:
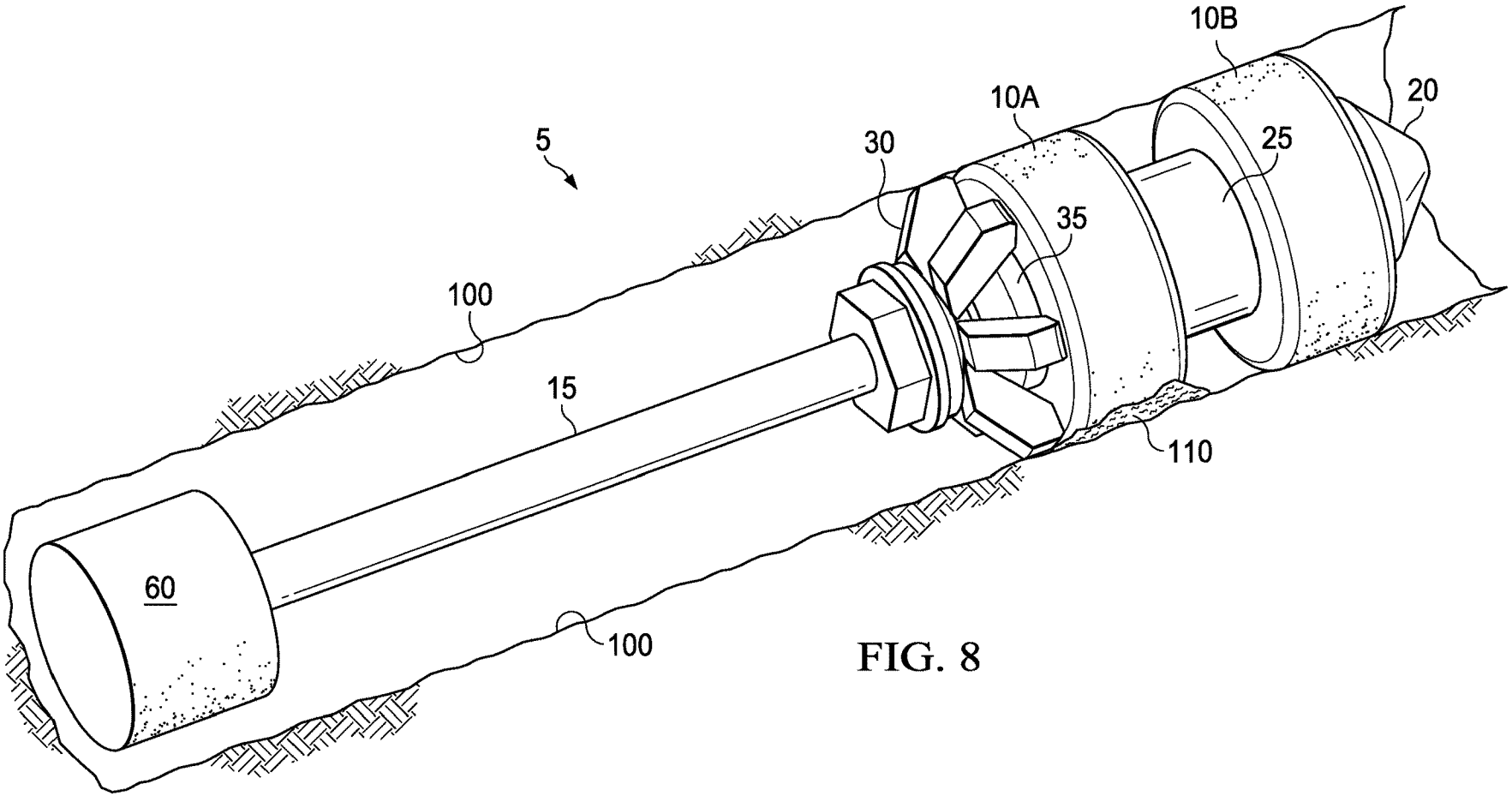
FIG. 8 is an isometric illustration of the bridge plug of FIGS. 1-3 coupled to a setting tool in accordance with one or more examples described herein.

FIG. 8 is illustrates bridge plug 5 coupled to a setting tool 60. Setting tool 60 may be any setting tool configured to actuate the bridge plug 5.

Figure 9:
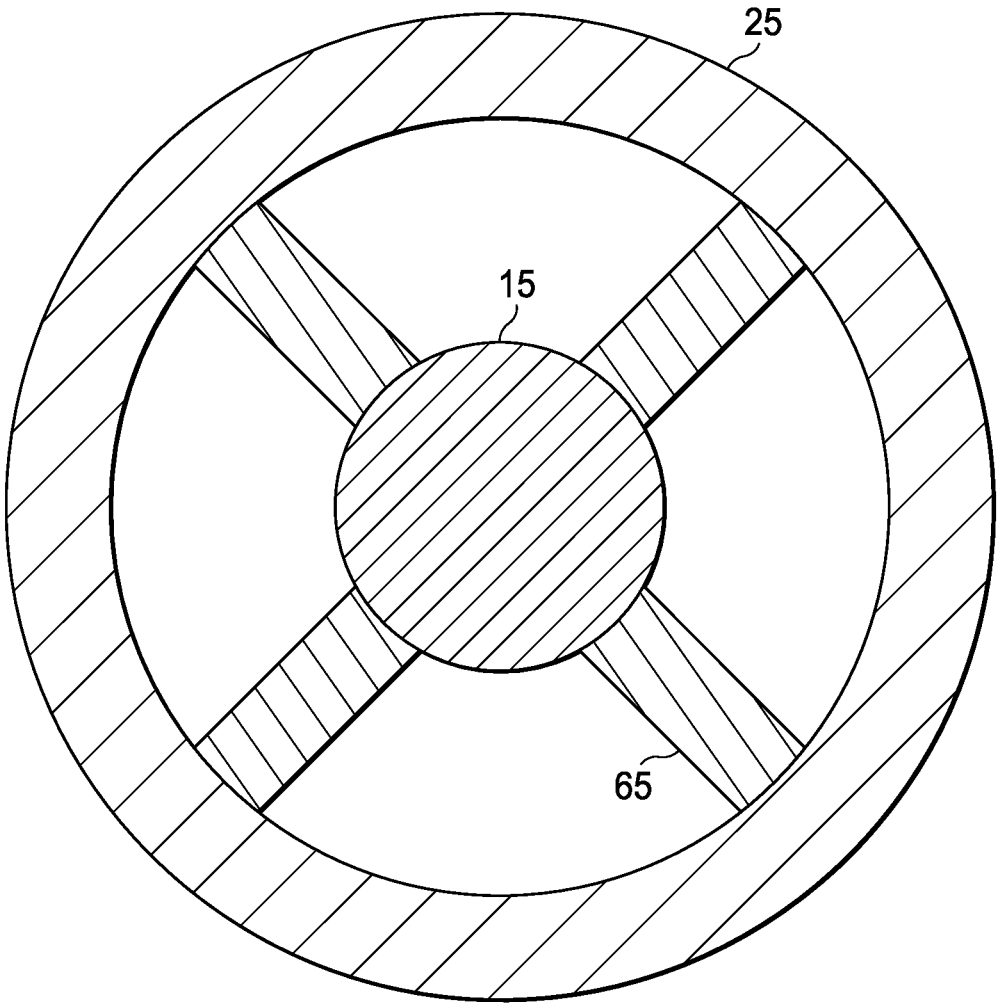
FIG. 9 is a cross-section of the bridge plug of FIGS. 1-3 illustrating the spacer coupled to the mandrel with a shearable structure in accordance with one or more examples described herein.

FIG. 9 illustrates the spacer 15 coupled to the mandrel 25 with a shearable structure 65. Spacer 15 moves with mandrel 25 until an applied pressure threshold is exceeded which shears shearable structure 65 and decouples the spacer 15 from the mandrel 25.

The sealing elements (for examples sealing elements 10A and 10B) may comprise any elastomeric material sufficient for use in the example bridge plugs disclosed herein. In some optional examples, the sealing elements may also comprise swellable materials. The swellable materials may be elastomeric or non-elastomeric materials. The swellable materials may be swellable in wellbore fluids. For example, the swellable materials may swell due to contact with aqueous or oleaginous fluids. In some examples, the sealing elements may comprise a composite material. The composite material may comprise any combination of swellable and/or non-swellable materials. Examples of the elastomeric materials include, but are not limited to, ethylene propylene diene monomer rubber, nitrile butadiene, styrene butadiene, any butyl rubber (e.g., brominated butyl rubber, chlorinated butyl rubber, etc.), any polyethylene rubber (e.g., chlorinated polyethylene rubber, sulphonated polyethylene, chlorsulphonated polyethylene, etc.), natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, the like, composites thereof, and any combination thereof.

The bridge plugs may be used in any wellbore and in any portion of any wellbore as described above, for example, cased, uncased, open hole, horizontal, slanted, vertical, etc. Although not illustrated, it is to be understood that the principles described herein are equally applicable to subsea operations that employ floating or sea-based platforms and rigs without departing from the scope of the disclosure. Moreover, the bridge plugs may also be used in mining operations. For example, the bridge plug may be passed through a core bit and then expanded into an open hole section of a borehole for a mining operation. The bridge plug may then be anchored at a desired location and set by the expansion of the sealing elements. The bridge plug may then seal the borehole of the mining operation, isolating lower zones or allowing for the borehole to be plugged with a cement plug.

It is also to be recognized that the disclosed bridge plugs, methods of use, and corresponding systems may also directly or indirectly affect the various downhole equipment and tools that may contact the bridge plugs. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in FIGS. 1-3.

Provided are bridge plugs in accordance with the disclosure and the illustrated FIGs. An example bridge plug comprises a first sealing element, a second sealing element, and a spacer; wherein the spacer is disposed between the first sealing element and the second sealing element; wherein the first sealing element and the second sealing element are not adjacent to one another.

Additionally or alternatively, the bridge plug may include one or more of the following features individually or in combination. The first sealing element may comprise an elastomeric material selected from the group consisting of: ethylene propylene diene monomer rubber, nitrile butadiene, styrene butadiene, butyl rubber, brominated butyl rubber, chlorinated butyl rubber, polyethylene rubber, chlorinated polyethylene rubber, sulphonated polyethylene, chlor-sulphonated polyethylene, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof. The first sealing element may be a composite material. The bridge plug may further comprise a plurality of slips. The slips may comprise a deformable metal. The bridge plug may not be retrievable. The slips in the plurality may comprise hinges. The bridge plug may be retrievable. The bridge plug may be configured to actuate the slips in the plurality before actuation of the first sealing element and the second sealing element. The first sealing element may be disposed uphole of the second sealing element, and the bridge plug may be configured to actuate the first sealing element before actuation of the second sealing element.

Provided are methods of setting a bridge plug in a subterranean formation in accordance with the disclosure and the illustrated FIGs. An example method comprises introducing a bridge plug into a borehole penetrating the subterranean formation, wherein the bridge plug comprises: a first sealing element, a second sealing element, a spacer; wherein the spacer is disposed between the first sealing element and the second sealing element; wherein the first sealing element and the second sealing element are not adjacent to one another, and a plurality of slips. The method further comprises actuating the slips; actuating the first sealing element; and actuating the second sealing element.

Additionally or alternatively, the method may include one or more of the following features individually or in combination. The first sealing element may comprise an elastomeric material selected from the group consisting of: ethylene propylene diene monomer rubber, nitrile butadiene, styrene butadiene, butyl rubber, brominated butyl rubber, chlorinated butyl rubber, polyethylene rubber, chlorinated polyethylene rubber, sulphonated polyethylene, chlor-sulphonated polyethylene, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof. The first sealing element may be a composite material. The bridge plug may further comprise a plurality of slips. The slips may comprise a deformable metal. The bridge plug may not be retrievable. The slips in the plurality may comprise hinges. The bridge plug may be retrievable. The bridge plug may be configured to actuate the slips in the plurality before actuation of the first sealing element and the second sealing element. The first sealing element may be disposed uphole of the second sealing element, and the bridge plug may be configured to actuate the first sealing element before actuation of the second sealing element. The borehole may be a wellbore penetrating a hydrocarbon producing formation. The method may further comprise pumping cement on top of the set bridge plug to form a cement plug. The method may further comprise passing the bridge plug through a core bit; wherein the bridge plug is set in an open hole section of the borehole; wherein the borehole is a borehole for a mining operation.

The borehole may comprise an open hole section; wherein the bridge plug is set in the open holes section such that at least the first sealing element contacts the open hole borehole wall after actuation. The set bridge plug may isolate a water producing zone downhole of the bridge plug. The actuation of the slips, the first sealing element, and the second sealing element may be performed in one trip into the borehole.

Provided are systems for setting a bridge plug in a subterranean formation in accordance with the disclosure and the illustrated FIGs. An example system comprises a bridge plug comprising: a first sealing element, a second sealing element, a spacer; wherein the spacer is disposed between the first sealing element and the second sealing element; wherein the first sealing element and the second sealing element are not adjacent to one another, a mandrel; wherein the first sealing element, the second sealing element, and the spacer are disposed on the mandrel, and a plurality of slips. The system further comprises a setting tool configured to couple to a terminal end of the mandrel.

Additionally or alternatively, the system may include one or more of the following features individually or in combination. The first sealing element may comprise an elastomeric material selected from the group consisting of: ethylene propylene diene monomer rubber, nitrile butadiene, styrene butadiene, butyl rubber, brominated butyl rubber, chlorinated butyl rubber, polyethylene rubber, chlorinated polyethylene rubber, sulphonated polyethylene, chlor-sulphonated polyethylene, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof. The first sealing element may be a composite material. The bridge plug may further comprise a plurality of slips. The slips may comprise a deformable metal. The bridge plug may not be retrievable. The slips in the plurality may comprise hinges. The bridge plug may be retrievable. The bridge plug may be configured to actuate the slips in the plurality before actuation of the first sealing element and the second sealing element. The first sealing element may be disposed uphole of the second sealing element, and the bridge plug may be configured to actuate the first sealing element before actuation of the second sealing element. The bridge plug may be configured to actuate the slips, the first sealing element, and the second sealing element in one trip into the borehole; wherein the setting tool is decoupled from the mandrel after the actuation of the slips, actuation of the first sealing element, and actuation of the second sealing element. The bridge plug may be configured to actuate the slips in the plurality before actuation of the first sealing element and the second sealing element. The first sealing element may be disposed uphole of the second sealing element; wherein the bridge plug is configured to actuate the first sealing element before actuation of the second sealing element.

The preceding description provides various embodiments of the apparatuses, systems, and methods disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system.

It should be understood that the compositions and methods are described in terms of "comprising," "containing," or "including" various components or steps. The compositions and methods can also "consist essentially of" or "consist of" the various components and steps. Moreover, the indefinite articles "a" or "an," as used in the claims, are defined herein to mean one or more than one of the element that it introduces.

Therefore, the present embodiments are well adapted to attain the ends and advantages mentioned, as well as those that are inherent therein. The particular embodiments disclosed above are illustrative only, as the present invention may be modified and practiced in different but equivalent manners apparent to those skilled in the art having the benefit of the teachings herein. Although individual embodiments are discussed, the invention covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified, and all such variations are considered within the scope and spirit of the present invention.

What is claimed is:

1. A bridge plug comprising:

a first sealing element, a second sealing element, a mandrel, and a spacer; wherein the spacer is disposed between the first sealing element and the second sealing element; wherein the space is shearably coupled to the mandrel such that the spacer is pulled uphole when the mandrel is pulled uphole, wherein the shearable coupling is configured to shear upon sufficient force such that the spacer is no longer coupled to the mandrel when the coupling is shear: wherein the first sealing element and the second sealing element are not adjacent to one another.

2. The bridge plug of claim 1, wherein the first sealing element comprises an elastomeric material selected from the group consisting of: ethylene propylene diene monomer rubber, nitrile butadiene, styrene butadiene, butyl rubber, brominated butyl rubber, chlorinated butyl rubber, polyethylene rubber, chlorinated polyethylene rubber, sulphonated polyethylene, chlor-sulphonated polyethylene, natural rubber, ethylene propylene monomer rubber, peroxide crosslinked ethylene propylene monomer rubber, sulfur crosslinked ethylene propylene monomer rubber, ethylene vinyl acetate rubber, hydrogenized acrylonitrile-butadiene rubber, acrylonitrile butadiene rubber, carboxylated acrylonitrile butadiene rubber isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof.

3. The bridge plug of claim 2, wherein the first sealing element is a composite.

4. The bridge plug of claim 1, further comprising a plurality of slips.

5. The bridge plug of claim 4, wherein the slips are a deformable metal; and wherein the bridge plug is not retrievable.

6. The bridge plug of claim 4, wherein the slips in the plurality comprise hinges; and wherein the bridge plug is retrievable.

7. The bridge plug of claim 4, wherein the bridge plug is configured to actuate the slips in the plurality before actuation of the first sealing element and the second sealing element.

8. The bridge plug of claim 7, wherein the first sealing element is disposed uphole of the second sealing element; wherein the bridge plug is configured to actuate the first sealing element before actuation of the second sealing element.

9. A method of setting a bridge plug in a subterranean formation, the method comprising:

introducing a bridge plug into a borehole penetrating the subterranean formation, wherein the bridge plug comprises:

a first sealing element, a second sealing element, a mandrel, a spacer; wherein the spacer is disposed between the first sealing element and the second sealing element; wherein the spacer is shearably coupled to the mandrel such that the spacer is pulled uphole when the mandrel is pulled uphole, wherein the shearable coupling is configured to shear upon sufficient force such that the spacer is no longer coupled to the mandrel when the coupling the sheared; wherein the first sealing element and the second sealing element are not adjacent to one another, and a plurality of slips;

actuating the slips;

actuating the first sealing element; and actuating the second sealing element.

10. The method of claim 9, wherein the borehole is a wellbore penetrating a hydrocarbon producing formation.

11. The method of claim 9, further comprising pumping cement on top of the set bridge plug to form a cement plug.

12. The method of claim 9, further comprising passing the bridge plug through a core bit; wherein the bridge plug is set in an open hole section of the borehole; wherein the borehole is a borehole for a mining operation.

13. The method of claim 9, wherein the borehole comprises an open hole section; wherein the bridge plug is set in the open holes section such that at least the first sealing element contacts the open hole borehole wall after actuation.

14. The method of claim 9, wherein the set bridge plug isolates a water producing zone downhole of the bridge plug.

15. The method of claim 9; wherein the actuating the slips; actuating the first sealing element; and actuating the second sealing element are performed in one trip into the borehole.

16. The method of claim 9, wherein the first sealing element comprises an elastomeric material selected from the group consisting of: ethylene propylene diene monomer rubber, nitrile butadiene, styrene butadiene, butyl rubber, brominated butyl rubber, chlorinated butyl rubber, polyethylene rubber, chlorinated polyethylene rubber, sulphonated polyethylene, chlor-sulphonated polyethylene, natural rubber, ethylene propylene monomer rubber, peroxide cross-linked ethylene propylene monomer rubber, sulfur cross-linked ethylene propylene monomer rubber, ethylene vinyl acetate rubber, hydrogenized acrylonitrile-butadiene rubber, acrylonitrile butadiene rubber, carboxylated acrylonitrile butadiene rubber isoprene rubber, carboxylated hydrogenized acrylonitrile-butadiene rubber, chloroprene rubber, neoprene rubber, polynorbornene, tetrafluoroethylene/propylene, polyurethane rubber, epichlorohydrin/ethylene oxide copolymer rubber, silicone rubber, composites thereof, and any combination thereof.

17. A system for setting a bridge plug in a subterranean formation, the system comprising:

a bridge plug comprising:

a first sealing element, a second sealing element, a mandrel, a spacer; wherein the spacer is disposed between the first sealing element and the second sealing element; wherein the spacer is shearably coupled to the mandrel such that the spacer is pulled uphole when the mandrel is pulled uphole; wherein the shearable coupling is configured to shear upon sufficient force such that the spacer is no longer coupled to the mandrel when the coupling is sheared, wherein the first sealing element and the second sealing element are not adjacent to one another, a mandrel; wherein the first sealing element, the second sealing element, and the spacer are disposed on the mandrel, and a plurality of slips; and a setting tool configured to couple to a terminal end of the mandrel.

18. The system of claim 17, wherein the bridge plug is configured to actuate the slips; actuate the first sealing element; and actuate the second sealing element in one trip into the borehole; wherein the setting tool is decoupled from the mandrel after the actuation of the slips, actuation of the first sealing element, and actuation of the second sealing element.

19. The system of claim 17, wherein the bridge plug is configured to actuate the slips in the plurality before actuation of the first sealing element and the second sealing element.

20. The system of claim 19, wherein the first sealing element is disposed uphole of the second sealing element; wherein the bridge plug is configured to actuate the first sealing element before actuation of the second sealing element.

* * * * *